United States Patent [19]

Perkins, Jr.

[11] 4,171,863

[45] Oct. 23, 1979

[54] TRANSFORMER TERMINAL SUPPORT

[75] Inventor: Norman P. Perkins, Jr., Westminster, Md.

[73] Assignee: Gould Inc., Rolling Meadows, Ill.

[21] Appl. No.: 909,832

[22] Filed: May 26, 1978

[51] Int. Cl.[2] ..... H01R 9/10; H01F 15/10

[52] U.S. Cl. ..... 339/263 R; 336/96; 336/192

[58] Field of Search ..... 339/263 R, 246; 310/71; 336/96, 192, 65, 67

[56] References Cited

U.S. PATENT DOCUMENTS 3,609,654 9/1971 Wallo ..... 339/263 R X

FOREIGN PATENT DOCUMENTS 864287 1/1953 Fed. Rep. of Germany ..... 339/263 R

*Primary Examiner*—Thomas J. Kozma

*Attorney, Agent, or Firm*—Ostrolenk, Faber, Gerb & Soffen

[57] ABSTRACT

A terminal support assembly suitable for encapsulation by a molded resinous block wherein transformer windings are disposed, is constructed of an elongated relatively stiff resilient support member and a plurality of U-shaped terminal members. The terminal members are mounted to and retained in operative position on the support member solely by a snap-fit interlocking engagement with the latter. In this operative position slight relative movement between the terminals and support member is permitted to compensate for tolerances involved in subsequent operations connecting the assembly to other elements.

10 Claims, 16 Drawing Figures

50
51
52
53
54
55
56
57
58
59
9A
9B
9C

TRANSFORMER TERMINAL SUPPORT

This invention relates generally to terminals and supports therefor, and more particularly relates to a terminal support assembly adapted for encapsulation by a resinous molding.

U.S. Pat. No. 3,516,040 issued June 2, 1970, to J. F. Ripley et al for a Transformer Structure describes a control transformer having coils encapsulated by a molded block of resinous material. This type of transformer, referred to as a control transformer, is typically rated at between 50 and 150 volt amps. Usually such a transformer is used to furnish power for indicators and control elements of electrical switching equipment mounted within an enclosure.

Prior art transformers of this type have been relatively expensive due in part to time spent in assembling numerous small elements. In particular, it was customary to connect individual terminals and then utilize a temporary fastening means to hold the terminals in position for encapsulation. Handling of the subcomponents was delicate.

In order to improve manufacturing procedures and produce a more reliable product, the instant invention provides a terminal support assembly which includes an elongated support member which supports a plurality of terminal members in operative positions to have solder connection made thereto and then to be encapsulated. Fast reliable mounting of the terminals to the support member is achieved by utilizing an interlocking snap-fit.

Accordingly, a primary object of the instant invention is to provide a control transformer which includes novel terminal support assemblies that facilitate transformer assembly operations.

Another object is to provide a terminal support assembly which is relatively rugged and easy to assemble.

A further object is to provide a terminal support assembly in which the sole means securing the terminals in their support member is a snap-fit engagement therebetween.

These objects as well as other objects of this invention shall become readily apparent after reading the following description of the accompanying drawings in which:

FIG. 1 is a side elevation of a control transformer embodying terminal support assemblies constructed in accordance with teachings of the instant invention.

FIGS. 2 and 3 are plan and end views respectively of the transformer of FIG. 1 looking in the directions of the respective arrows 2—2 and 3—3 in FIG. 1.

Figures 5, 6, 7, 7A, 7B, 7C, 8, 8A:
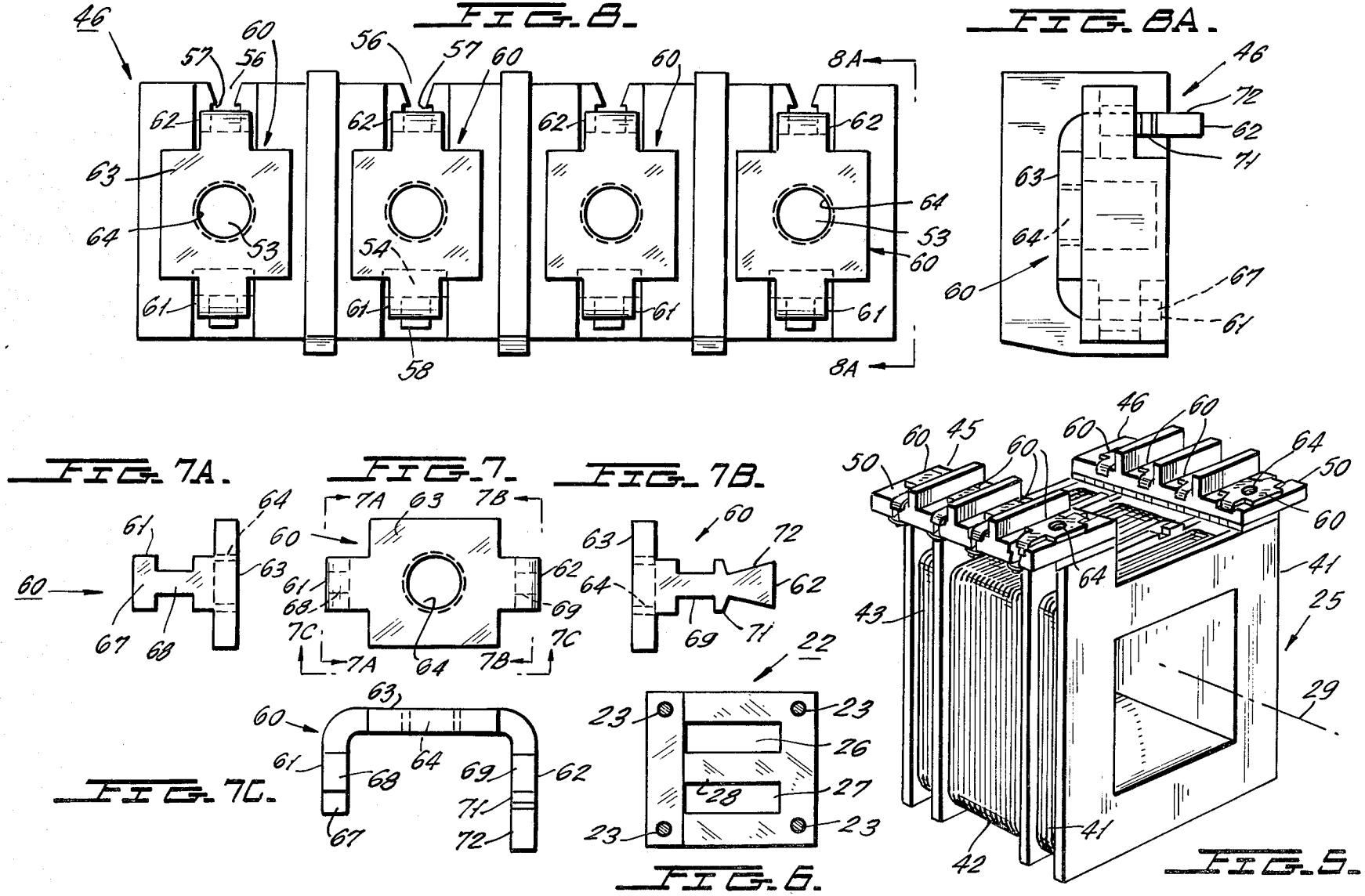
FIG. 5 is a perspective of the coil assembly.
FIG. 6 is a reduced side elevation of the transformer core.
FIG. 7 is an enlarged plan view of one of the terminal members.
FIGS. 7A, 7B and 7C are elevations of the terminal member of FIG. 7 looking in the directions of the respective arrows 7A—7A, 7B—7B and 7C—7C.
FIG. 8 is an enlarged plan view of one of the terminal support assemblies constructed in accordance with the instant invention.
FIG. 8A is an end view of the terminal support assembly of FIG. 8 looking in the direction of arrows 8A—8A.

Now referring to the Figures. Control transformer 20 includes coil assembly 25 (FIG. 5) encapsulated by ring 21 molded of resinous material. Magnetic core 22 is a conventional construction of E and I laminations secured in a stack by four rivets 23 to define two windows 26, 27 separated by leg 28 of magnetic core 22. Core leg 28 extends through opening 24 defined by ring 21. The longitudinal axis of leg 28 coincides with through axis 29 of openings 24.

Figure 1:
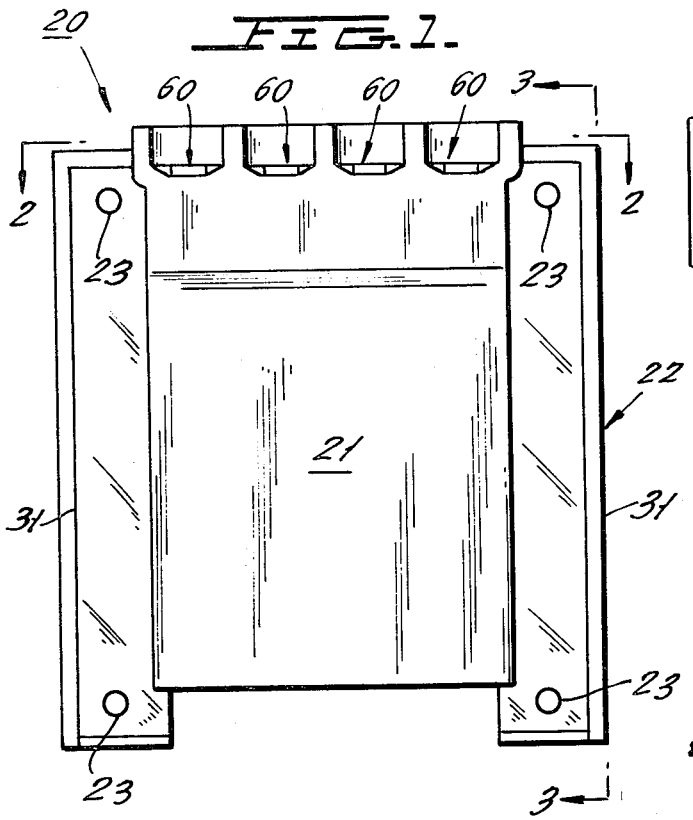
Figure 3:
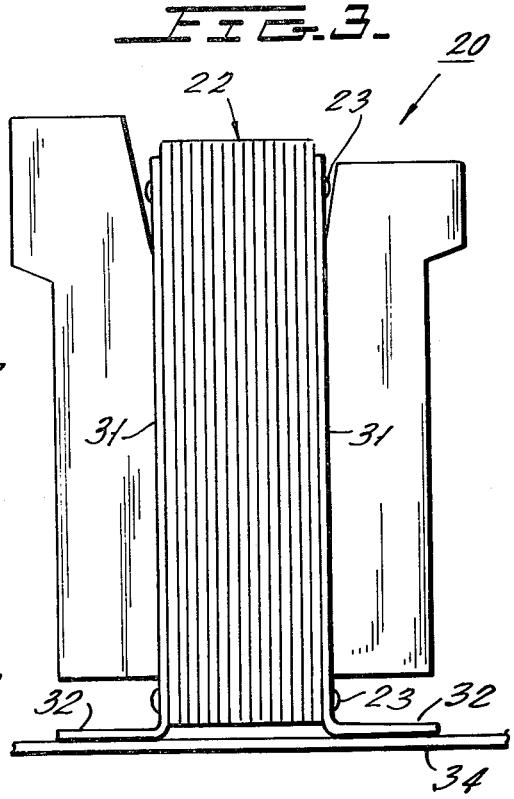

Rivets 23 secure four brackets 31 to core 22. The rear of each bracket 31 is formed as an outturned foot 32 which sits on the forward surface of enclosure wall 34 (FIG. 3) to which transformer 20 is secured by fastening means extending through elongated mounting apertures 33 in mounting feet 32. It is noted that with transformer 20 mounted on enclosure wall 34, through axis 29 of ring aperture 24 is parallel to the mounting surface provided by wall 34.

Coil assembly 25 includes insulating bobbin 41 having secondary coil 42 and primary coils 43, 44 wound thereabout. Substantially identical spaced parallel terminal support assemblies 45, 46, each consisting of an elongated support member 50 to which four terminal members 60 are mounted, is cemented to bobbin 41 at the front thereof. As an alternate, bobbin 41 and assemblies 45, 45 may be combined as a single molded member.

Terminal member 60 (FIG. 7) is a generally U-shaped member having spaced arms 61, 62 extending rearwardly from web 63. The latter is provided with threaded aperture 64 for the making of external circuit connections by means of binding screws, wire grips, spring clips, etc. (not shown). For a reason to be hereinafter seen, shorter arm 61 is constructed with reduced section 68 between enlarged section 67 and web 63, and longer arm 62 is constructed with reduced section 69 disposed between enlarged section 71 and web 63.

Figure 2:
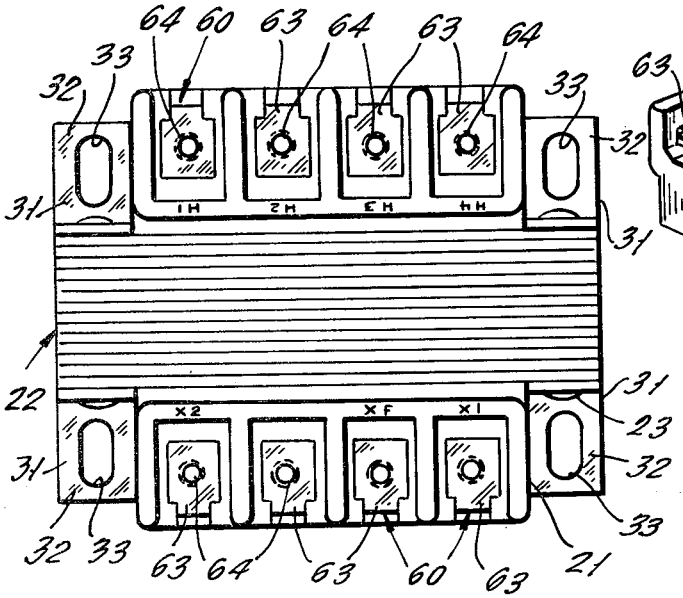
Figure 4:
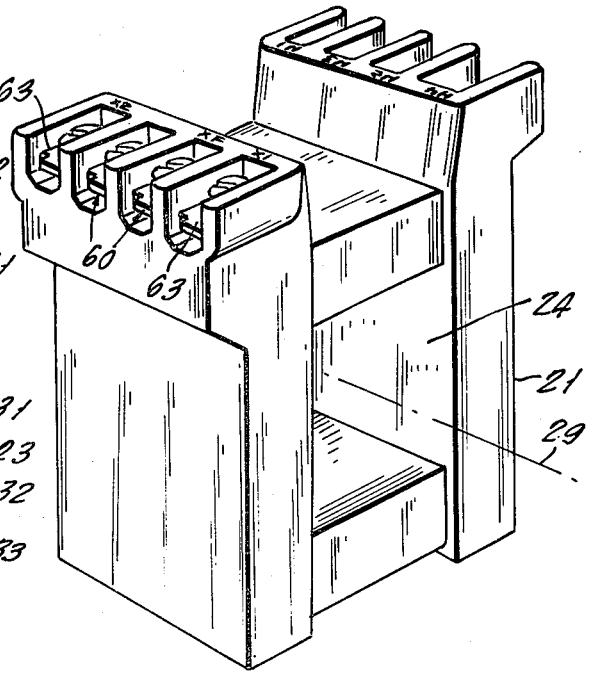
FIG. 4 is a perspective of the encapsulated coil assembly.

Extension 72 of arm 62, projecting to the rear of enlarged portion 71, is provided as a terminal for making solder connections to transformer windings 42-44. In particular, the ends of secondary 25 are connected to terminals 60 designated X1 and X2 in FIG. 2, the ends of one primary 44 are connected to terminals 60 designated H3 and H4, and the ends of the other primary 43 are connected to terminals 60 designated H1 and H2. The connections between primaries 43, 44 are made externally of ring 21 and depend upon available voltage.

Figures 9, 9A, 9B, 9C:
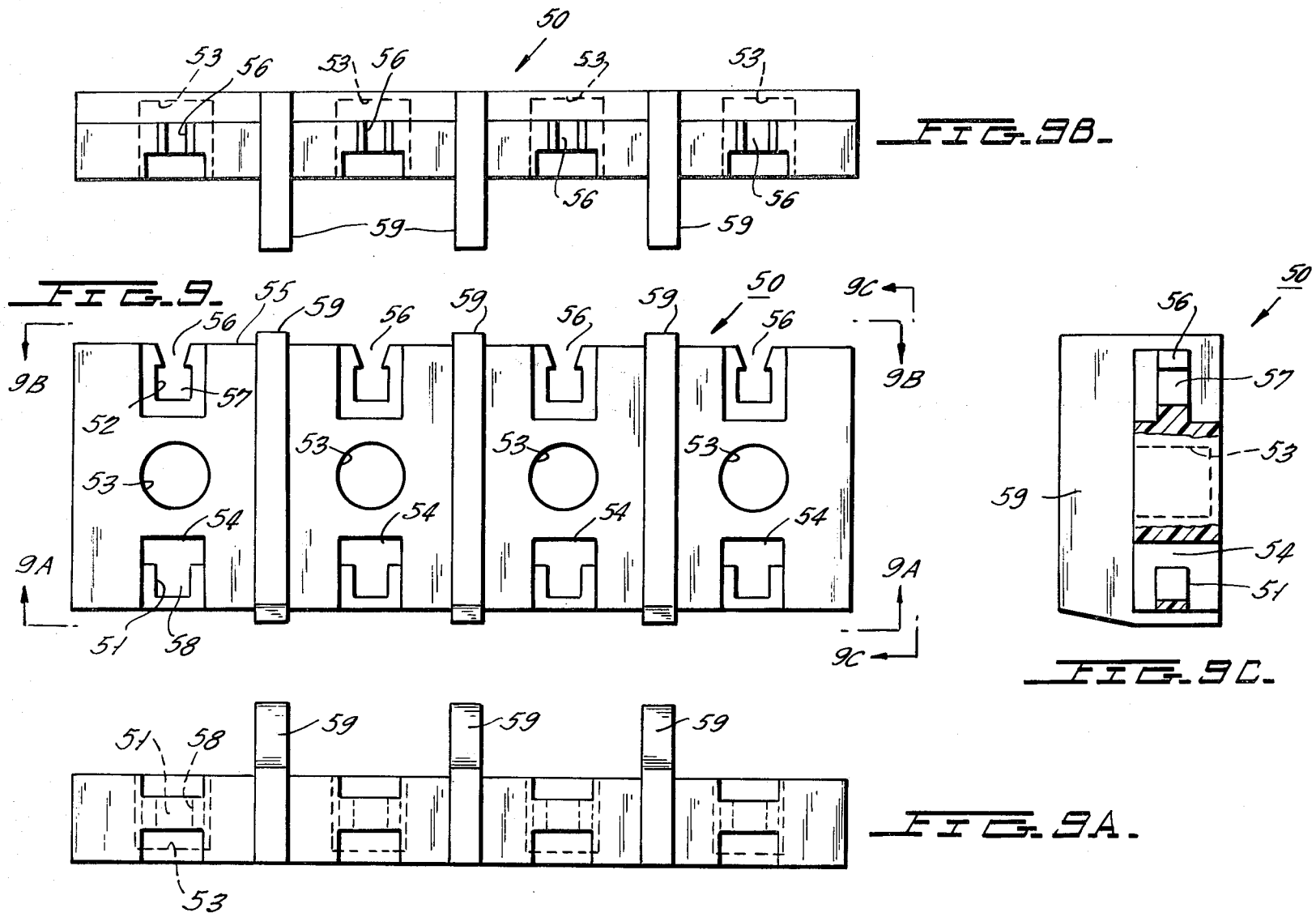
FIG. 9 is an enlarged plan view of one of the terminal mounting members.
FIGS. 9A, 9B and 9C are elevations of the terminal support member of FIG. 9 looking in the directions of the respective arrows 9A—9A, 9B—9B and 9C—9C.

Support member 50 (FIG. 9) is constructed of a relatively rigid resilient insulating material, such as a phenolic rubber. For each terminal 60 mounted to member 50, the latter includes a T-shaped aperture 51 to receive the short arm 61 of terminal member 60 and another aperture 52 to receive long arm 62 of terminal member 60. Disposed between each pair of apertures 51, 52 is a recess 53 which is closed at the rear thereof and provides clearance for a fastener extending through threaded aperture 65.

Each of the terminals 60 is mounted to and retained in operative position on support member 50 merely by reason of a snap-fit engagement. More particularly, each terminal 60 is mounted to support member 50 by inserting leg 61 rearwardly through the enlarged section 54 of aperture 51 while the other arm 62 is positioned outboard of support member edge 55 to which wide mouth extension 56 of aperture 52 extends. With the rear surface of web 63 resting against support member 50, terminal leg 62 is moved past support member edge 55 and through wide mouth extension 56 into enlarged portion 57 of aperture 52. The width of reduced section 69 of arm 62 is such that as reduced section 69 moves through extension 56 its sides spread until the point where reduced section 69 is in aperture section 57. At this point the sides of extension 56 snap back to their normal positions shown in FIG. 9 wherein the narrow end of extension 56 is narrower than reduced section 69 of terminal member arms 62, thereby capturing leg 62 in aperture 52.

The movement just described is not impeded since reduced section 68 of arm 61 is narrow enough to be received by reduced section 58 of aperture 51. The enlarged portions 67, 71 of arms 61, 62 are positioned at the rear of support member 50 thereby blocking forward movement of terminal member 60.

It is noted that the cross-sectional area of reduced section 69 is less than the area of aperture section 57. This permits a slight relative movement, or floating action, between each of the terminal members 60 and the support member 50 to which it is mounted. This compensates for variations that might occur when coil assembly 25 is inserted in the mold for making encapsulating ring 21. It is also noted that support member 50 provides forwardly extending barriers 59 disposed between webs 63 of adjacent terminal members 60.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. A terminal support assembly including a support member constructed of resilient plastic insulating material, a plurality of generally U-shaped metal terminal members mounted on said support member with a snap fit; each of said terminal members including spaced first and second arms and a web connecting said arms; for each of said arms said support member having spaced first and second apertures through which the respective first and second arms extend with said web positioned at the front of said support member; said first aperture having a reduced portion extending to a side edge of said support member; said reduced portion being defined by a section of said support member which, during mounting of said terminal members on said support member, spreads from a normal condition to permit movement of said first arm therethrough into an enlarged portion of said first aperture and then snaps back to said normal position to retain said first arm in said enlarged portion.

2. An assembly as set forth in claim 1 in which the web includes a threaded aperture for making connections to conductors of an external circuit; one of said arms including a free end section for making connections with conductors extending from other sections of a device of which said assembly is a part.

3. An assembly as set forth in claim 1 in which each of said arms includes a relatively enlarged section and a relatively reduced section interposed between said web and said enlarged section; said enlarged sections being at the rear of said support member.

4. An assembly as set forth in claim 3 in which the enlarged section of the first arm is too large to travel through the enlarged portion of the first aperture.

5. An assembly as set forth in claim 4 in which the second aperture includes relatively enlarged and reduced portions with the latter being more remote than the former from said first aperture; said enlarged section of said second arm being too large to pass through the reduced portion of the second aperture but being small enough to pass through the enlarged portion of the second aperture.

6. An assembly as set forth in claim 5 in which with the terminal member mounted on the support member in operative position, the reduced section of the first section extends through the enlarged portion of the first aperture and the reduced section of the second section extends through the reduced portion of the second aperture.

7. An assembly as set forth in claim 6 in which the arms and apertures are relatively proportioned to permit limited relative movement between the terminal and support members prior to embedding them in a potting material.

8. An assembly as set forth in claim 6 in which the support member is provided with integrally formed barriers interposed between adjacent ones of said terminals.

9. An assembly as set forth in claim 6 in which during mounting of said terminal member to said mounting member said second arm is moved rearward through said second aperture until said enlarged sections of said arms are at the rear of the support member and then said second arm is moved transverse to its length through the reduced portion of said first aperture.

10. An assembly as set forth in claim 1 in which the enlarged portion of the first aperture tapers downward from a wide-mouth located at the end of the reduced portion of said first aperture remote from the enlarged portion thereof.

* * * * *